United States Patent [19]

Kovach et al.

[11] 4,405,445

[45] Sep. 20, 1983

[54] HOMOGENIZATION OF WATER AND REDUCED CRUDE FOR CATALYTIC CRACKING

[75] Inventors: Stephen M. Kovach; Edward B. Cornelius, both of Ashland, Ky.

[73] Assignee: Ashland Oil, Inc., Ashland, Ky.

[21] Appl. No.: 295,335

[22] Filed: Aug. 21, 1981

[51] Int. Cl.[3] ..... C10G 11/14

[52] U.S. Cl. ..... 208/120; 208/113; 208/158; 208/162; 208/253; 208/127

[58] Field of Search ..... 208/120, 113, 158, 162

[56] References Cited

U.S. PATENT DOCUMENTS

| | | | |
|---|---|---|---|
| 2,035,120 | 3/1936 | Forrest et al. | 208/125 |
| 2,994,659 | 8/1961 | Slyngstad et al. | 208/113 |
| 3,152,064 | 10/1964 | Osborne | 208/78 |
| 3,254,019 | 5/1966 | Mitchell et al. | 208/87 |
| 3,303,123 | 2/1967 | Payton et al. | 208/76 |
| 3,547,805 | 12/1970 | Mitchell | 208/48 |
| 3,654,140 | 4/1972 | Griffel et al. | 208/113 |
| 3,725,250 | 4/1973 | Wilson et al. | 208/208 R |
| 3,812,029 | 5/1974 | Snyder, Jr. | 208/113 |
| 4,149,960 | 4/1979 | Garwood et al. | 208/111 |
| 4,309,274 | 1/1982 | Bartholic | 208/80 |
| 4,311,580 | 1/1982 | Bartholic | 208/91 |
| 4,332,673 | 6/1982 | Myers | 208/120 |
| 4,347,122 | 8/1982 | Myers et al. | 208/120 |

OTHER PUBLICATIONS

Shankland & Schmitkons "Determination of Activity and Selectivity of Cracking Catalyst" Proc. API 27(III) 1947, pp. 57–77.

*Primary Examiner*—Delbert E. Gantz
*Assistant Examiner*—G. E. Schmitkons
*Attorney, Agent, or Firm*—Richard C. Willson, Jr.

[57] ABSTRACT

An improved process for economically converting carbo-metallic oils to lighter products. Enhanced catalyst activity is enjoyed through use of a select process to vaporize and atomize the high boiling portion of a carbo-metallic oil feed. The carbo-metallic oil feed is dispersed into droplets having a diameter of at least smaller than 350 microns and preferably 100 microns or less. These small droplets ensure more even coverage of the catalyst surface and decrease diffusion problems. The water utilized for dispersion of the carbo-metallic oil feed is present as a homogenized mixture in fine oil droplets with an average diameter below 1,000 microns. The water is dispersed in the carbo-metallic oil feed through use of a select mixing apparatus and can be dispersed as finer droplet sizes through use of an emulsifying or dispersing agent. The ratio of water to carbo-metallic oil feed ranges from about 0.04 to 0.25 by weight and the concentration of emulsifying agent ranges from 0.01 to 10 wt. % based on the weight of water.

28 Claims, 1 Drawing Figure

HOMOGENIZATION OF WATER AND REDUCED CRUDE FOR CATALYTIC CRACKING

TECHNICAL FIELD

This invention relates to processes for converting carbo-metallic oils into lighter fractions and especially to processes for converting heavy hydrocarbons containing high concentrations of coke precursors and heavy metals into gasoline and other liquid hydrocarbon fuels. In one aspect the invention is related to the intimate mixing or dispersion of water and the carbo-metallic oil to improve feed atomization, catalyst-feed and catalyst-water contact.

BACKGROUND ART

Many processes are available for the converions of the various fractions of crude oil to transportation and heating fuels. These processes include alkylation, polymerization, reforming, hydrocracking and fluid catalytic cracking. The technology of fluid catalytic cracking (FCC) has evolved around the process of cracking feedstocks boiling below 1050° F., commonly referred to as atmospheric and vacuum gas oils (VGO), in the absence of added molecular hydrogen and at low pressures below 50 psig. The gas oil feedstocks contain low, if any, concentrations of coke precursors such as asphaltenes, naphthenes and porphyrins to provide a Conradson carbon below 0.5 wt% and contaminant metals (Ni-V-Cu-Na), below 0.2 ppm by weight. However, the availability of select crudes that contain a high percentage of clean gas oils has diminished and have been replaced by crude oils containing higher percentages of 1050+ material containing high concentrations of Conradson carbon producing materials and contaminant metals. The materials known as reduced crude, topped crude, atmospheric tower bottoms and the like, essentially boil above about 650° F. and contain material boiling above 1050° F., whose endpoint can be as high as 1500°-1700° F. Thus, a reduced crude with vacuum tower bottoms contains all of the Conradson carbon and contaminant metal values as opposed to atmospheric and vacuum gas oils which generally contain a trace of these materials depending on crude source.

Petroleum refiners have been investigating means for processing reduced crudes, such as by visbreaking, solvent deasphalting, hydrotreating, hydrocracking, coking, Houdresid fixed bed cracking, H-oil, and fluid catalytic cracking. One or more approaches to the processing of reduced crude to form transportation and heating fuels is that described in copending applications, U.S. Ser. Nos. 904,216 (now U.S. Pat. No. 4,341,624); 904,217 (now U.S. Pat. No. 4,347,122); 094,091 (now U.S. Pat. No. 4,299,687); 094,227 (now U.S. Pat. No. 4,354,923) and 094,092 (now U.S. Pat. No. 4,332,673) which are herein incorporated by reference thereto.

In the operations of the above identified applications, a reduced crude is contacted with a hot regenerated catalyst in a short contact time riser cracking zone, the catalyst and products are separated instantaneously by means of a vented riser to take advantage of the difference between the momentum of gases and catalyst particles. The catalyst is stripped, sent to a regenerator zone and the regenerated catalyst is recycled back to the riser to repeat the cycle. Due to the high Conradson carbon values of the feed, coke deposition on the catalyst is high and can be as high as 12 wt% based on feed. This high coke level can lead to excessive temperatures in the regenerator, at times in excess of 1400° F. to as high as 1500° F., which can lead to rapid deactivation of the catalyst through hydrothermal degradation of the active cracking component of the FCC catalyst (crystalline aluminosilicate zeolites) and unit metallurgical failure.

As described in the above mentioned co-pending reduced crude patent applications, excessive heat generated in the regenerator is overcome by heat management through utilization of a two-stage regenerator, generation of a high $CO/CO_2$ ratio to take advantage of the lower heat of combustion of C to CO versus CO to $CO_2$, low feed and air preheat temperatures and water addition in the riser as a catalyst coolant. As described and taught in these applications water is added to the feed prior to contact with the regenerated catalyst and the carbo-metallic feedstock-catalyst mixture is benefited in several respects. These benefits include some catalyst cooling, generation of steam for aiding feed dispersion, lowering of feed partial pressure and assisting as a transport lift gas. This mixing of water and carbo-metallic oil does not necessarily produce the ultimate desired effect of feed dispersion through small droplet size formation (misting) and, better and more consistent catalyst cooling through better contact of catalyst and water droplets. Therefore, a much better method of dispersion of carbo-metallic oil with water is desirable to achieve more complete, consistent and intimate catalyst-water contact with carbo-metallic oil dispersion into very fine droplets to provide a more intimate catalyst-oil contact in the riser.

SUMMARY OF THE INVENTION

It is an object of this invention to provide a method and means for obtaining improved mixing of a carbo-metallic containing oil and water as a highly dispersed mixture and including a homogenized mixture. A homogenized mixture, for example, of a carbo-metallic containing high boiling oil and water will permit better feed dispersion and intimate contact more rapidly with the fluid catalyst particles and thus more uniform catalyst utilization to provide the required endothermic heat of cracking to desired product selectivity in the absence of undesired cracking excursions because of poor mixing. The uniformity with which the catalyst heat is rapidly dispersed to the reduced crude within a contact time frame less than 2 seconds contributes substantially to produce selectivity obtained.

In accordance with the invention a process is provided for converting carbo-metallic containing oils to lighter products comprising: (a) providing a high boiling feed containing 650° F.+ material, said 650° F.+ material being characterized by a carbon residue on pyrolysis of at least about one and containing at least about 4 ppm of nickel equivalents of heavy metals; (b) dispersing said high boiling feed together with water as an intimate highly uniform mixture; (c) bringing the resulting mixture of feed and water into highly dispersed contact with a special cracking catalyst to form a high temperature dispersed phase suspension with said catalyst particles, causing the resulting suspension to flow through a progressive flow reactor zone for a predetermined vapor residence time in the range of about 0.5 to about 4 seconds, at a temperature in the range of about 900° F. to about 1200° F. and a reactor pressure of about atmospheric to about 40 pounds per square inch absolute, obtaining a conversion per pass of the feed in the range of about 50% to about 90% and depositing hydrocarbonaceous material on the catalyst comprising coke in the range of about 6 to about 14% by weight based on fresh feed; (d) separating said suspension comprising catalyst from the resultant vaporous hydrocarbon cracked products; (e) stripping vaporous hydrocarbons from said separated catalyst; (f) regenerating said catalyst; and (g) recycling the regenerated catalyst to the reactor for contact with additional hydrocarbon feed and water. Steam may be added also to facilitate dispersion contact between catalyst and hydrocarbon feed.

The step of distributing the water as very fine droplets uniformly throughout the hydrocarbon feed may be accomplished by many different techniques such as by the use of atomizing nozzles or more severe homogenizing equipment which will increase the interfacial contact between the water and the feed and ultimately with catalyst particles so as to enhance some of the advantages achieved by adding water. For example, it appears to permit increasing the amount of high boiling constitutents in the feed passed to catalytic cracking. Furthermore, when the water-feed mixture of relatively low temperatures below 600° F. is brought into contact with hot catalyst particles at a temperature between 1300° and 1400° F., the water is converted to steam, and this rapidly breaks the feed droplets into even finer particles for enhancing the intimate contact desired.

In carrying out this invention the water and carbo-metallic high boiling hydrocarbon feed are added together and a mixture thereof is subjected to shear forces sufficiently high to homogenize the mixture. The feed is preheated to reduce its viscosity to a temperature of at least about 300° F., and more usually, to a temperature in the range of about 350° F. to about 450° F. The water feed mixture is homogenized under a pressure at least high enough to maintain water in the liquid phase.

The amount of water to be used depends upon factors discussed in more detail below, and the ratio of water to feed by weight may suitably range from about 0.04 to about 0.25, and is preferably in the range of about 0.05 to about 0.15.

The homogenization may be carried out in a pressure vessel or in a conduit leading to the reactor. High speed propellors, high speed aperture discs, or other high shear agitating means may be used to homogenize the oil-water mixture. Emulsifying agents may optionally be used to assist with dispersion or in the homogenization. Examples of typically useful emulsifying agents are anionic surfactants, petroleum sulfonates, guanidine salts and aliphatic alcohols which may be added in amounts ranging from about 0.01 to 10% by weight of the feed. Emulsification or homogenization of oil and water can also be obtained through use of ultra-sonic devices.

The homogenization may result in either the water or the oil as the continuous phase although in view of the larger volume of oil, the homogenized mixture will typically be a water in oil mixture, i.e., the oil will be the continuous phase. The average size of the droplets, such as droplets of water in the oil continuous phase of the homogenized mixture may range from less than 10 microns to over 1,000 microns and the average size is preferably in the range of about 10 to about 500 microns.

The homogenized mixture of feed and water is introduced into the reactor either as a continuous liquid stream or as fine droplets from a spray nozzle and in a preferred method the homogenized mixture is admixed with hot catalyst particles as relatively fine droplets having an average size less than about 350 microns and more preferably having an average size less than about 100 microns. In co-pending application, Ser. No. 263,391 filed May 13, 1981, a feed having a droplet size of less than about 20 microns is identified as especially useful for catalytically cracking carbo-metallic oils comprising high-boiling hydrocarbons. In using the homogenizing concept of this invention, droplets brought into contact with hot catalyst particles contain both water and oil, and the rapid heating of water within the droplets to fine steam breaks the oil into even smaller droplets thus obviating the need for providing special high cost atomizing apparatus to produce carbo-metallic oil droplets significantly smaller than about 100 microns and of about 200 microns size or less.

BEST AND OTHER ILLUSTRATIVE MODES FOR CARRYING OUT THE INVENTION

Figure 1:
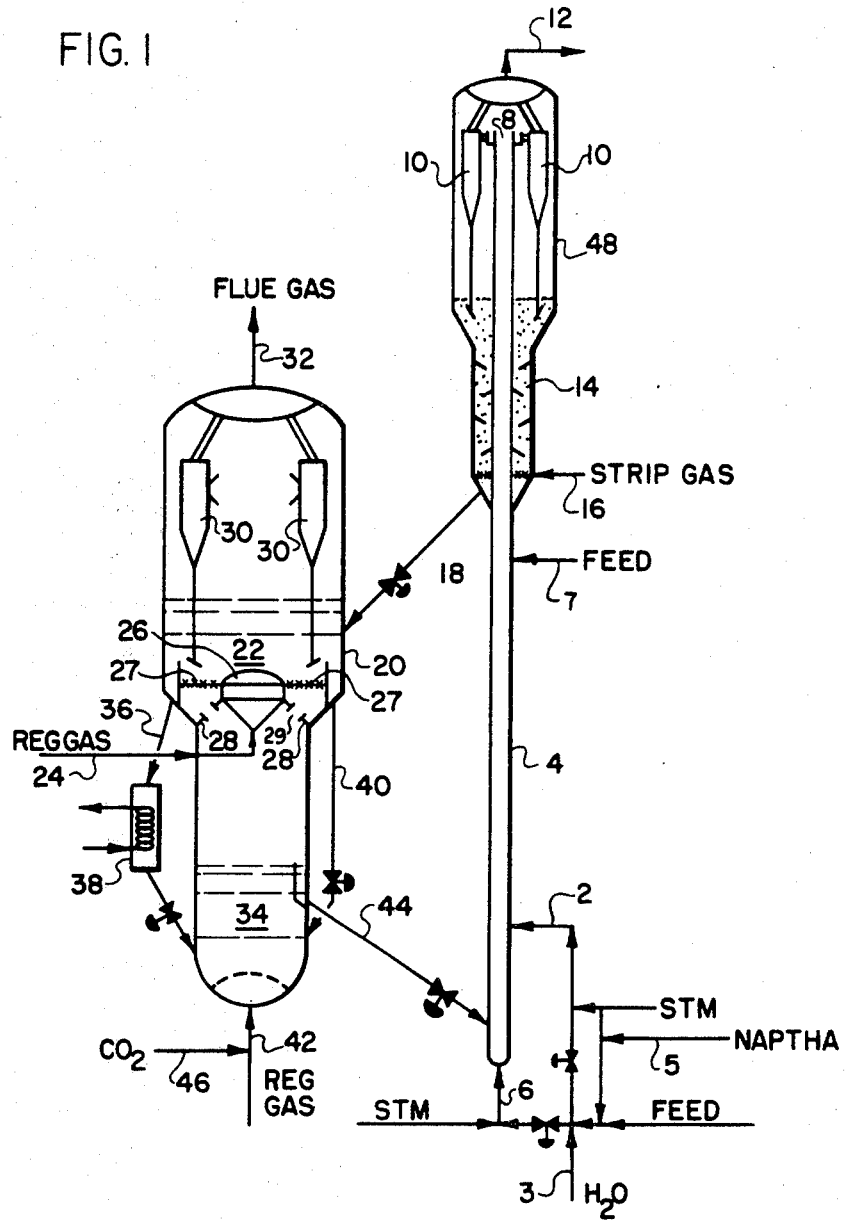
FIG. 1 is a schematic diagram of an apparatus arrangement for carrying out the process of the invention.

The present invention is directed to an improvement in the approach to the conversion of carbo-metallic oil feeds, such as reduced crude or the like, to lighter and heavier products such as gasoline and fuel oils. The carbo-metallic oil feed comprises an oil which boils above about 650° F. and includes vacuum tower bottoms. Such oils are characterized by a heavy metal content of at least about 4 ppm, and preferably at least about 5.5 ppm of Nickel Equivalents by weight and by a carbon residue on pyrolysis of at least about 4% and more usually at least about 6% by weight. In accordance with the invention, the carbo-metallic feed, in the form of a pumpable liquid, is mixed or dispersed with water to provide a highly agitated mixture thereof such as a homogenized mixture which is brought into dispersed phase contact with hot conversion catalyst normally in the presence of added steam and in a weight ratio of catalyst to oil feed in the range of about 3 to about 19 and preferably more than about 6 to 1.

The hydrocarbon feed in said mixture undergoes conversion hich includes cracking while the mixture of feed, steam and catalyst flows as a high temperature suspension through a progressive flow type reactor. The reactor is an elongated reaction chamber in which the feed material, resultant products of cracking, steam and catalysts are maintained in contact with one another while flowing as a dilute phase for a predetermined reactor residence time in the range of about 0.5 to about 5 seconds. The feed, catalyst, and dispersion diluent materials may be introduced into the reactor at one or more spaced points along the length of the reactor such as a riser reactor.

The cracking reaction is conducted at a temperature to provide a riser outlet temperature of about 900° to about 1200° F., at a hydrocarbon residence time less than 5 seconds, at a total pressure of about 10 to about 50 psia (pounds per square inch absolute), under conditions sufficiently severe to provide a conversion per pass in the range of about 50% or more, and to lay down coke on the catalyst in the form of hydrocarbonaceous deposits in an amount in the range of about 0.3 to about 3% by weight of catalyst and preferably at least about 0.5%. The overall rate of coke production, based on weight of fresh feed, is in the range of about 4 to about 14% by weight.

At the end of a predetermined and selected hydrocarbon residence time in the riser, the catalyst is separated from the products, is stripped to remove vaporous components and is then regenerated with oxygen-containing combustion-supporting gas under conditions of time, temperature and atmosphere sufficient to reduce residual carbon on the regenerated catalyst to below 0.1% and preferably below 0.05% or less by weight. The regenerated catalyst is recycled at a desired temperature to the riser to repeat the cycle.

The invention is applicable to carbo-metallic oils, whether of petroleum origin or not. For example, provided they have the requisite boiling range, carbon residue on pyrolysis and heavy metal content, the invention may be applied to the processing of such widely diverse materials as heavy bottoms from crude oil, heavy bitumen crude oil, those crude oils known as "heavy crude" which approximate the properties of reduced crude, shale oil, tar sand extract, products from coal liquification and solvated coal, atmospheric and vacuum reduced crude, aromatic extract from lube oil refining, tar bottoms, heavy cycle oil, slop oil, and refinery waste stream comprising mixtures of the foregoing. Such mixtures can for instance be prepared by mixing available hydrocarbon fractions, including oils, tars, pitches and the like. Also, powdered coal may be suspended in the carbo-metallic oil.

Persons skilled in the art are aware of techniques for demetalation of carbo-metallic oils, and demetalated oils may be converted following the processing concepts of the invention; however, an advantage of the invention process is that feedstocks comprising carbo-metallic oils that have had no prior demetalation treatment can be employed. Likewise, the concepts of the invention are applicable to feestocks with or without prehydrogenation treatment. A preferred application of the process is directed to processing reduced crude, i.e., that fraction or portion of crude oil boiling above 650° F., alone or in admixture with atmospheric virgin gas oils. The use of feed material that has been subjected to vacuum distillation is not excluded; however, an advantage of the invention is that high boiling feeds recovered in the absence of vacuum distillation may be processed, thus saving on capital investment and operating costs as compared with the more conventional FCC processes that depend upon vacuum distillation to clean up the feed charge.

In the process of the invention a carbo-metallic oil feedstock with or without atmospheric gas oils and comprising at least about 70%, of materials which boil above about 650° F. and comprising the residual material normally separated by vacuum distillation is charged as the feed. All boiling temperatures herein identified are based on standard atmospheric pressure conditions. Carbo-metallic oil partly or wholly composed of material which boils above about 650° F. is referred to herein as 650° F.+ material. The carbo-metallic oils processed according to the invention contain material which do not boil under any conditions; that is, certain asphalts and asphaltenes, porphyrins and some multi-ring high molecular weight compounds crack thermally during distillation, apparently without boiling. These non-boilable materials for the most part are concentrated in portions of the feed which do not boil below about 1025° F. or 1050° F.

Preferably, the contemplated high boiling feeds have a carbon residue on pyrolysis of at least about 2 or greater. For example, the Conradson carbon content may be in the range of about 2 to about 12 and most frequently at least about 4. A particularly common range is about 4 to about 8. These feeds providing a Conradson carbon deposition on the cracking catalyst greater than about 6 require special consideration for controlling excess heat in the combustion thereof in a regenerator.

The high boiling hydrocarbon feeds generally have a composition characterized by an atomic hydrogen to carbon ratio in the range of about 1.2 to about 1.9, and more usually in the range of about 1.3 to about 1.8.

In the carbo-metallic feeds contemplated and containing high boiling oil, at least the 650° F.+ material will contain at least about 4 parts per million of Nickel Equivalents, as defined by the formula Ni eq.$=Ni+V/4.8+Fe/7.1+Cu/1.23$ (metals as ppm by weight).

The carbo-metallic containing oil feeds processed as herein provided also usually contain significant quantities of heavy, high boiling compounds containing nitrogen, a substantial portion of which may be basic nitrogen. For example, the total nitrogen content of the carbo-metallic oils may be at least about 0.05% by weight. Since cracking catalysts owe their cracking activity to acid sites on the catalyst surface or in its pores, basic nitrogen-containing compounds may temporarily neutralize some of these sites, thereby poisoning the catalyst. However, the catalyst is not permanently damaged since the nitrogen is removed during combustion of carbonaceous deposits during catalyst regeneration, as a result of which, the acidity of the active sites is restored.

The carbo-metallic oils may also include significant quantities of pentane insolubles, for example, at least about 0.5% by weight, and more typically 2% or more or even about 4% or more. These may include for instance asphaltenes and other materials.

The carbo-metallic oil containing feedstock thus constitutes in one embodiment at least about 70% by volume of material which boils above about 650° F., and at least about 10% of the material which boils above and outside the range of 650° F. up to about 1025° F. The average composition of this 650° F.+ material may be further characterized by: (a) an atomic hydrogen to carbon ratio in the range of about 1.3 to about 1.8; (b) a Conradson carbon value of at least about 2; (c) at least about four parts per million of Nickel Equivalents, as defined above, of which at least about two parts per million is nickel (as metal, by weight); and (d) at least one of the following: (i) at least about 0.3% by weight of sulfur, (ii) at least about 0.05% by weight of nitrogen, and (iii) at least about 0.5% by weight of pentane insolubles. Very commonly, the preferred feed will include all of (i), (ii), and (iii), and other components found in oils of petroleum and non-petroleum origin may also be present in varying quantities providing they do not prevent desired operation of the process. In general, the weight ratio of catalyst to fresh feed used in the process is in the range of about 3 to about 19. Preferred ratios are from about 4 to about 12, a ratio of about 10 presently being considered most desirable for some feeds.

The process of the invention is practiced with catalyst bearing accumulations of heavy metal(s) in the form of elemental metal(s), oxide(s), sulfide(s) or other compounds which heretofore would have been considered quite intolerable in conventional FCC-VGO operations. Thus, operation of the process with catalyst bearing heavy metals accumulations at least of about 3,000 or more ppm Nickel Equivalents, on the average, is contemplated. The concentration of Nickel Equivalents of metals on the catalyst can also be as high as about 50,000 ppm or higher. More specifically, the metals accumulation may be in the range of about 6,000 to 30,000 ppm, and preferably at least 10,000 ppm. Within these ranges one can tend to reduce the rate of catalyst replacement required.

One may employ any one of a number of different hydrocarbon cracking catalysts for cracking reduced crude with varying results. A preferred class of catalysts includes those which have pore structures into which high molecular weight component of the feed material may enter for adsorption and/or contact with active catalytic sites within or adjacent the pores. Various catalysts compositions are available particularly comprising crystalline zeolites dispersed in a matrix material considered neutral or comprising catalytic activity. The matrix material may be silica alumina or a mixture of silica-alumina in admixture with a clay binder material. A particularly desirable zeolite is catalytically activated crystalline "Y" faujasite zeolite containing high levels of lanthanum and cerium in a high ratio.

The zeolite-containing catalysts may include substantially any zeolite, whether natural, semi-synthetic or synthetic, in admixture with other materials which do not significantly impair the desired activity and pore structure of the catalyst. For example, if the virgin catalyst is a mixture, it may include the zeolite component associated with or dispersed in a porous refractory inorganic oxide carrier. In such case the catalyst may contain from about 10% to about 60%, and more peferably from about 20 to about 45% by weight of zeolite based on the total weight of catalyst (water free basis). The balance of the catalyst comprises one or more porous refractory inorganic oxides alone or in combination with any of the known adjuvants for promoting or suppressing various desired and undesired reactions.

The zeolite component of the catalysts will be those which are known to be useful in FCC cracking processes. In general, these are crystalline aluminosilicates, typically made up of tetra coordinated aluminum atoms associated through oxygen atoms with adjacent silicon atoms in the crystal structure. However, the term "zeolite" as used in this disclosure contemplates not only aluminosilicates, but also substances in which the aluminum has been partly or wholly replaced such as for instance by gallium and/or other metal atoms, and further includes substances in which all or part of the silicon has been replaced, such as for instance by germanium. Titanium and zirconium substitution may also be practiced.

Examples of the naturally occuring crystalline aluminosilicate zeolites which may be used as or included in the catalyst for the present invention are faujasite, mordenite, clinoptilote, chabazite, analcite, crionite, as well as levynite, dachiardite, paulingite, noselite, ferriorite, heulandite, scolccite, stibite, harmotome, phillipsite, brewsterite, flarite, datolite, gmelinite, caumnite, leucite, lazurite, scaplite, mesolite, ptolite, nephline, matrolite, offretite and sodalite.

Examples of the synthetic crystalline aluminosilicate zeolite which are useful as or in the catalyst for carrying out the present invention are zeolites X, Y, A, B, D, F, H, J, L, M, O, Q, S, T, W, Z, Omega, ZK-411J, alpha, beta and ZSM-type.

The crystalline aluminosilicate zeolites having a faujasite-type crystal structure are particularly preferred for use in the present invention. This includes particularly natural faujasite, Zeolite X, Zeolite Y and combinations thereof.

A catalyst composition particularly suitable for use in the present invention is characterized by having matrices with feeder pores having large minimum diameters and large pore size openings in the range of 500 to 2000 angstroms to facilitate diffusion of high molecular weight molecules in the matrix to the portal surface area of molecular sieve particles within the matrix. Such matrices preferably also have a relatively large pore volume in order to soak up unvaporized portions of the carbo-metallic oil feed. Thus significant numbers of liquid hydrocarbon molecules can diffuse to active catalytic sites both in the matrix and in sieve particles on the surface of the matrix. In general it is preferred to employ catalysts having a total pore volume greater than 0.2 cc/gm, preferably at least 0.4 cc/gm and more usually in the range of 0.5–0.8 cc/g. The matrix pore size may have some diameters in the range of about 400 to about 6000 angstrom units with a major portion thereof in the range of 500 to 2000 angstroms.

A catalyst comprising a combination of two or more different catalytically activeted crystalline zeolites haing distinctly determinable different pore sizes may be employed. A relatively large pore size opening crystalline zeolite is represented by type X and Y crystalline faujasites and the like. A second type of crystalline zeolite of smaller pore size may be mixed therewith to provide pore size openings in the range of about 4A up to about 13A and the combination utilized for selective cracking and isomerization of normal paraffins or olefins. A selective n-paraffin conversion zeolite is represented by A-type zeolite, mordenite, erionite, offretite and other small pore zeolite identified in the prior art.

The reduced crude cracking catalyst is therefore comprised of a Y type crystalline zeolite, with rare earth stabilization, with or without admixture of a smaller pore size opening zeolite to provide a catalyst composition highly selective for conversion of reduced crudes. A combination crystalline zeolite catalyst may comprise from about 5 to about 40 wt% of a faujasite crystalline zeolite in combination with 5 to 40 wt% of a smaller pore size opening zeolite. These zeolitic components used separately or together are preferably bound together by a matrix material comprising silica, alumina, silica-alumina, kaolin, activated clays or other known binder materials suitable for the purpose.

Additives may be employed with the catalyst to passivate the non-selective catalytic activity of heavy metals deposited on the conversion catalyst. Preferred additives for this purpose include those disclosed in copending U.S. patent application Ser. No. 263,395, filed May 13, 1981 in the name of William P. Hettinger, Jr., and entitled, PASSIVATING HEAVY METALS IN CARBO-METALLIC OIL CONVERSION, the entire disclosure of said U.S. application being incorporated herein by reference.

Catalysts for carrying out the present invention may also employ metal additives for controlling the adverse effects of vanadium as described in PCT International Application, Ser. No. PCT/US81/00356 filed in the U.S. Receiving Office on Mar. 19, 1981, and entitled, "Immobilization of Vanadia Deposited on Catalytic Materials During Carbo-Metallic Oil Conversion", also U.S. Ser. No. 277,751. A particularly preferred catalyst also includes vanadium traps as disclosed in U.S. patent application, Ser. No. 252,967 filed Apr. 10, 1981, in the names of William P. Hettinger, Jr., et al., and entitled, "Trapping of Metals Deposited on Catalytic Materials During Carbo-Metallic Oil Conversion". It is also preferred to control the valence state of vanadium accumulations on the catalyst during regeneration as disclosed in the U.S. patent application Ser. No. 255,348 entitled, "Immobilization of Vanadium Deposited on Catalytic Materials During Carbo-Metallic Oil Conversion" filed in the names of William P. Hettinger, Jr., et al., on Apr. 20, 1981, as well as the continuation-in-part Ser. No. 258,265 of the same application subsequently filed on Apr. 28, 1981. The entire disclosures of said PCT international application and said U.S. patent applications are incorporated herein by reference.

In accordance with one aspect of this invention, the mixing and dispersing of oil and water mixtures may be achieved with devices which include Kady Mills, Dispersators, Colloid Mills used alone or in combination with fine droplet atomizing nozzles. Some of these homogenizers depend on close tolerances between their milling surfaces for effecting shear, attrition and impact forces to produce dispersion. The Kady Mill, on the other hand, does not depend on close tolerance between its surfaces and also avoids shear as much as possible, but utilizes impact and attrition for its effective and efficient dispersion action. The Kady Mill dispersion unit consists of a pressure vessel (capable of 100 psia and 550° F.) and a bottom propeller to assist in bottom batch movement and a slotted motor operating within a slotted stator partially enclosed at the top and bottom by head plates. The rotor, operating at high speeds (rotor rim speeds of 8700 fpm), functions as a pump and draws material from above and below, and jets it at high speed through the slots in the stationary ring surrounding it. Dispersion is affected mainly by impact. The agglomerate leaves the rotor tangentially at high speed and is abruptly stopped by the stationary wall of the stator slot. Its direction is then changed and after two additional but lesser impacts, it emerges into the match in a jet stream where a degree of internal shear assists in the dispersion or homogenization process.

Another means of homogenizing oil and water is through the use of a Dispersator with a high velocity mixing head in the appropriate vessel that can maintain pressure up to 100–400 psig and temperatures as high as 550° F. The high viscosity mixing head is known as Premier Hi-Vis and can handle materials with viscosities as high as 30,000 centipoises. The high viscosity oil plus water is sucked in the end of the Dispersator or through the slots as the slotted cylindrical head rotates at high speed. Centrifugal force whirls and material out through the slots. Thus the material (oil and water) is sheared hydraulically as it passes through the slots, and sheared by the blades of material emerging from the rotating cylinder and knifing into the slower-moving liquid mass. This action overcomes surface forces and produces breakdown of particle size (water droplet size).

Another method for effecting the homogenization of oil and water is through the use of a colloid mill. This operation can produce water droplets in oil below 1,000 microns in size. The material to be dispersed or emulsified is fed to a rapidly spinning rotor. This rotor is closely matched to a stationary stator as to distance between the rotor and stator (0.001–0.125 inches). As the material comes in contact with the rotor it is flung out to the edge by centrifugal force. This force pushes the material through the narrow gap between the rotor and stator. This imparts high shear to the material and overcomes the surface forces tending to hold the material together. The material (oil and water) makes its way through the shear zone and is flung out into an open area. The speed at which a colloid mill operates is extremely important. The linear speed at the rotor face, where the work is done, must be high enough to develop sufficient hydraulic shear. This linear speed is a function of RPM and rotor diameter and should be at least 3600 RPM.

The homogenization of water into a reduced crude by employment of one of the mixing devices described above can produce water droplet size near 1,000 microns. By incorporating an emulsification agent into the oil-water mixture this water droplet size can be further reduced dramatically. The use of an emulsifier can reduce water droplet size to below 1,000 microns, in particular to the size range of 10–350 microns. Examples of some typical emulsifiers and their range of concentrations in the oil-water mixture include $C_1-C_5$ low molecular weight alcohols and particularly methanol and isopropanol; 0.01–2 wt% anionic surfactant; 0.01–0.5 wt% of a quanidine salt; 0.01–0.5 wt% of an oxyalkylated N-containing aromatic compound such a nitrophenyl or quinolinyl sulfonyl polyalkylene hydroxide; 0.1–10 wt% of monoethanolamine nonyl or dodecyl orthoxylene sulfonate; 0.1–10% of a petroleum sulfonate. An important aspect of the use of a mixing vessel with an emulsifying agent and particularly the alcohols to yield a homogenized mixture of oil and water is the distribution of fine water droplets in the oil phase and the solubilizing effect of particularly isopropanol which will contribute to a fine oil droplet size upon introduction of the mixture into a riser reactor as by atomizing spray nozzles for contact with the hot regenerated catalyst. This homogenizing concept contributes substantially to improving contact between high boiling feed and catalyst whether used alone or in combination with highly efficient spray nozzles to obtain a more highly dispersed phase contact of reduced crude with fluid catalyst particles in a cracking time frame less than 3 seconds. This combination of water-reduced crude homogenization with emulsifying agent utilized with a highly efficient spray nozzle permits obtaining extremely small droplets formation or misting of the high boiling reduced crude feed so that the average droplet size of the unvaporized particles of reduced crude is of a very low order of magnitude and will ensure that pore filling or pore blockage is substantially avoided to ensure a maximum conversion thereof under substantially reduced catalyst diffusion problems.

The addition of steam to the reaction zone is frequently mentioned in the literature of fluid catalytic cracking. Addition of liquid water to the feed is also discussed. However, in accordance with the present invention liquid water is homogenized with the carbo-metallic oil with or without emulsifying agent in a weight ratio of about 0.04 to about 0.25. Also, the heat of vaporization of the water, which heat is absorbed from the catalyst, from the feedstock, or from both, provides a more efficient heat sink which upon conversion to steam promotes atomization of the feed as discussed herein. Preferably the weight ratio of liquid water to feed is within the range of about 0.05 to about 0.15.

The introduction of additional amounts of water as steam as a fluidizing medium into the same or different portions of the reaction zone such as with the catalyst and/or feedstock is contemplated. For example, the amount of additional steam may be in a weight ratio relative to feed in the range of about 0.01 to about 0.25, with the weight ratio of total $H_2O$ (as steam and liquid water) to feedstock being about 0.3 or about 25 to about 50 pounds per cubic foot.

When regenerating catalyst to very low levels of residual carbon on regenerated catalyst, e.g., about 0.1% or less or about 0.05% based on the weight of regenerated catalyst, it is desirable to pursue a two stage regeneration operation and burn off about the last 15% by weight of residual coke on the catalyst in the absence of hydrogen in contact with a combustion-producing gases containing excess oxygen. It is also contemplated effecting a regeneration operation wherein all of the deposited carbonaceous material is burned with excess oxygen. By excess oxygen is meant an amount in excess of the stoichiometric requirement for burning all of the hydrogen to water, all of the carbon to carbon dioxide and all of the other combustible components, such as sulfur and nitrogen which are present in the carbonaceous deposits of reduced crude cracking. The gaeous products of combustion or flue gases obtained in the presence of limited or excess oxygen may include an amount of free oxygen. Such free oxygen, unless removed from the by-product gases or converted to some other form by a technique other than carbon burning regeneration, will normally manifest itself as free oxygen in the flue gas from the regenerator unit.

Fluidization is maintained by passing gases, including combustion supporting gases, through a catalyst bed undergoing regeneration at a sufficient velocity to maintain the particles in a fluidized state but at a velocity which is low enough to prevent substantial and undesired extrainment of particles in the overhead flue gases. For example, the lineal velocity of the fluidizing gases may be in the range of about 0.2 to about 4 feet per second and preferably about 0.2 to about 3 feet per second. The average total residence time of the particles in one or more separate catalyst beds being regenerated is substantial, ranging for example, from about 5 to about 30 minutes and more usually from about 5 to about 20 minutes.

Heat released by combustion of coke in the regenerator is absorbed in part by the regenerated catalyst and is normally retained until the regenerated catalyst is brought into contact with fresh feed or other cooling agent. When processing carbo-metallic containing oils to relatively high levels of conversion the amount of regenerator heat which is transmitted to fresh feed by way of recycling regenerated catalyst can substantially exceed the level of heat input which is appropriate in the riser for heating, vaporizing the feed, vaporizing added water, and other materials, and for supplying the endothermic heat of reaction for cracking, as well as for making up the heat losses of the unit. Thus, the amount of regenerator heat transmitted to fresh feed may be controlled, or restricted as necessary, within certain desired ranges. The amount of heat so transmitted may for example be in the range of about 500 to about 1200, more particularly about 600 to about 900, and more particularly about 650 to about 850 BTUs per pound of fresh feed. The aforesaid ranges refer to the combined heat, in BTUs per pound of fresh feed, which is transmitted by the catalyst to the feed and reaction products (between the contacting of feed with the catalyst and the separation of product from catalyst) for supplying the heat of reaction (e.g., for cracking) and the difference in enthalpy between the products and the fresh feed.

One or a combination of techniques may be utilized for controlling or restricting the amount of regeneration heat transmitted via catalyst to fresh feed. For example, one may inhibit a combustion of carbonaceous material on the cracking catalyst in order to reduce the temperature of combustion to form carbon dioxide and/or carbon monoxide in the regenerator. Moreover, one may remove heat from the catalyst through heat exchange means, including for example, heat exchangers (e.g., steam coils) built into the regenerator itself, whereby one may extract heat from the catalyst during regeneration. Heat exchangers can be built into catalyst transfer lines, such as for instance the catalyst return line from the regenerator to the reactor, whereby heat may be removed from the catalyst after it is regenerated. One may also inject cooling fluids into portions of the regenerator other than those occupied by the dense bed and into the dense catalyst bed. For example water and/or steam may be directly added whereby the amount of gasiform material available in the regenerator for heat absorption and removal is increased.

Another suitable technique for controlling or restricting the heat transmitted to fresh feed via recycled regenerated catalyst involves maintaining a specified ratio between the carbon dioxide and carbon monoxide formed in the regenerator while such gases are in heat exchange contact or relationship with catalyst undergoing regeneration. In general, all or a major portion of weight of the coke present on the catalyst as hydrocarbonaceous deposits immediately prior to regeneration is removed in one or more combustion zones in which the aforesaid ratio is controlled as described below. More particularly, at least about 65% by weight of the coke on the catalyst is removed in a combustion zone in which the molar ratio of CO to $CO_2$ is maintained at a level providing a CO rich gas.

In this invention, CO production is promoted while catalyst is being regenerated to about 0.1% carbon or less, and preferably to about 0.05% carbon or less.

Another particular technique for controlling or restricting the regeneration heat imparted to fresh feed via recycled catalyst involves a diversion of a portion of the heat borne by recycled catalyst to added materials introduced before the reduced crude feed into the reactor, such as water, steam, naphtha, hydrogen donor materials, flue gases, inert gases, and other gaseous or vaporizable catalyst fluidizing materials which may be introduced into the reactor before the higher boiling feed.

The larger the amount of hydrocarbonaceous deposit which must be burned from a given weight of catalyst, the greater the potential for exposing the catalyst to excessive temperatures. Many desirable and useful cracking catalysts are particularly susceptible to hydrothermal deactivation at high temperatures, and among these are the crystalline zeolite containing cracking catalysts. The crystal structures of zeolites and the pore structures of the catalyst carriers or matrix material are susceptible to thermal and/or hydrothermal degradation. The use of such catalysts in catalytic conversion processes for carbo-metallic feeds creates a need for regeneration techniques which will not destroy the catalyst by exposure to highly severe temperatures and steaming. Such need can be met by a multi-stage regeneration process which includes conveying spent catalyst into a first regeneration zone and introducing oxidizing gas thereto. The amount of oxidizing gas that enters said first zone and the concentration of oxygen or oxygen bearing gas therein is sufficient for affecting only partial removal of carbonaceous material and effecting the desired conversion of hydrogen associated therewith to form carbon oxides. The thus partially regenerated catalyst with or without some retained hydrogen is then removed from the first regeneration zone and conveyed to a second regeneration zone. A regeneration gas such as oxygen, or $CO_2$ is introduced into the second regeneration zone to complete the removal of carbonaceous material to a desired low carbon level. The regenerated catalyst is then removed from the second zone and recycled to the hydrocarbon conversion zone for contact with fresh feed. An example of such multi-stage regeneration process is described in U.S. Pat. No. 2,398,739.

Multi-stage regeneration offers the possibility of combining oxygen deficient regeneration with the control of the $CO:CO_2$ molar ratio. Thus, about 50% and more usually about 65% to about 95%, by weight of the coke on the catalyst immediately prior to regeneration may be removed in one or more stages of regeneration in which the molar ratio of $CO:CO_2$ is controlled in the manner described above. Thus, a multi-stage regeneration operation is particularly beneficial in that it provides another convenient technique for restricting regeneration heat transmitted to fresh feed via regenerated catalyst and/or reducing the potential for thermal deactivation, while simultaneously affording an opportunity to reduce the carbon level on regenerated catalyst to very low percentages (e.g., about 0.1% or less) which particularly enhances catalyst activity. For example, a two-stage regeneration process may be carried out with the first stage combustion providing a bed temperature of about 1300° F. to produce a CO rich flue gas and the second stage combustion providing a bed temperature of about 1350° F. to also produce a CO rich flue gas with little, if any, free oxygen. Use of the gases from the second stage as combustion supporting gases in the first stage, along with additional air introduced into the first stage bed, results in a flue gas of high CO to $CO_2$ ratio. A catalyst residence time of up to 15 or 20 minutes total in the two zones is not unusual. However, the regeneration temperature conditions may be substantially more severe in the first regeneration zone than in the second zone such as when effecting endothermic removal of carbonaceous material with $CO_2$ in the second zone. That part of the regeneration sequence which involves the most severe conditions is performed while there is still an appeciable amount of carbonaceous deposit on the catalyst. Such operation may provide some protection to the catalyst from the regenerating conditions employed. A particularly preferred embodiment of the invention is a two-stage fluidized catalyst oxygen regeneration operation at a maximum temperature of about 1400° F. with a reduced temperature of at least about 10° to 20° F. in a dense catalyst phase of the first stage as compared to the dense catalyst phase of the second stage. The catalyst can thus be regenerated to carbon levels as low as 0.01% by this technique in the absence of thermal degradation even though the carbon on catalyst prior to regeneration is about 1 wt% or more.

Referring now to the FIGURE by way of example there is shown an arrangement of apparatus for practicing the processing management concepts of this invention with the special catalyst composition herein identified which operation permits a viable and economic reduced crude cracking operation. In the specific arrangements of the FIGURE, and one specific operating embodiment, the hydrocarbon feed comprising a reduced crude, residual oil or a topped crude comprising carbon-metallic oil impurities boiling above about 1025° F. is homogenized with water and is charged to a riser reactor conversion zone through one of the feed inlet conduit means 6 or 2 as desired to provide a vaporized hydrocarbon residence contact time with catalyst in the riser within the range of 0.5 seconds up to about 3 or 4 seconds but more usually within the range of 1 or 2 seconds. An emulsifying agent to increase the degree of reduced crude-water homogenization and reduce the water droplet size in the emulsion can be added to the water prior to introduction to the homogenizer section. The hydrocarbon feed so charged may be mixed with one or more of water, steam, naphtha, hydrogen and other suitable gasiform diluent material or a combination of these materials which will operate to achieve conversion of the feed desired, reduce the feed partial pressure, effect temperature control, and effect atomization-vaporization of the feed before and during contact with hot cracking catalyst. To reduce hydrocarbon residence time, provisions, not shown, are provided for adding one or more of the materials above identified for promoting the conversion desired, effect temperature control and assure efficient atomization-vaporization of the charged high boiling feed. In the hydrocarbon conversion operation of this invention, the high boiling charged oil feed comprising a reduced crude or residual oil may be recovered from, for example, an atmospheric distillation zone or a vacuum distillation zone (not shown). The feeds processed by this invention comprise materials having an initial boiling point as low as 650° or 700° F. or a higher boiling portion of the crude such as heavy vacuum gas oil and higher boiling residue material may be charged as the feed.

In the riser cracking zone 4, an upflowing suspension of the hydrocarbon feed, diluent material and suspended hot catalyst particles is formed at an elevated temperature sufficient to provide required endothermic heat of cracking and provide a vaporized hydrocarbon product-catalyst suspension at the riser discharge at a temperature within the range of 950° F. up to about 1150° F., and more usually at a temperature of at least about 1000° F. depending upon the severity of cracking and product slate desired. The riser cracking operation of this invention is accomplished with the special high activity-metals tolerant zeolite containing cracking catalyst herein defined and characterized as GRZ-1 Special at a hydrocarbon residence time in the riser preferably less than about 2 seconds and within the management parameters herein defined.

In the cracking operation of this invention it is contemplated employing one or more of several different operating techniques which include the addition of hydrogen to the feed as by adding molecular hydrogen with the feed or by the addition of a hydrogen donor diluent material such as $C_5$-paraffins, methanol or other labile hydrogen contributing materials. In yet another aspect, it is contemplated effecting a partial hydrogenation of the high boiling oil feed where very high concentrations of sulfur and nitrogen are present before cracking the feed as herein provided either with or without the pressure of added hydrogen. However, one advantage of the processing combination of this invention is the elimination of prehydrogenation of the feed before cracking thereof is provided herein.

The suspension following traverse of riser 4 is rapidly separated as by ballistic separation or other comparable means at the riser discharge 8 so that vaporous material with any entrained particle fines can be further separated in adjacent cyclone separating equipment 10 before recovery of vaporized hydrocarbons by conduit 12. The recovered vaporous hydrocarbons are passed to separation equipment not shown for recovery for desired product fractions comprising $C_2$–$C_5$ hydrocarbons, naphtha, gasoline, light and heavy fuel oil product fractions. Of these recovered product fractions, it is contemplated recycling recovered dry gas comprising hydrogen and methane, naphtha and $C_2$–$C_5$ hydrocarbons.

The upper end of riser 4 is confined within a vessel means 48 which is contiguous in the lower portion with an annular stripping zone about the riser in the specific arrangement of the drawing. It is contemplated however using a cylindrical stripping zone in association with a bottom portion of catalyst collecting vessel 48 through which riser 4 does not pass. The catalyst separated at the riser discharge and by the cyclones is collected about riser 4 in the arrangement of FIG. 1 and passed down through the annular stripping zone countercurrent to stripping gas charged by conduit 16. The stripping of catalyst in zone 14 is preferably accomplished at a temperature of at least 950° F. and is more desirably effective when accomplished at elevated temperatures of at least 1000° F. In this stripping environment, it is contemplated charging steam as a stripping medium in one embodiment to remove vaporized hydrocarbon material. In another embodiment it is preferred to employ high temperature $CO_2$ recovered from the combustion of CO rich flue gas obtained as herein provided or from other available sources as the stripping gas.

The use of $CO_2$ as the stripping medium where relatively high levels of hydrocarbonaceous materials are deposited on the catalyst is to obtain reaction with and at least partial removal of hydrogen associated with the carbonaceous deposits. The reaction of $CO_2$ with hydrogen to produce methane and water is known as the methanation reaction which is an exothermic reaction accomplished at temperatures in the range of about 700° to 800° F. Thus the promotion of this reaction in the stripping section may require some cooling of catalyst separated from the riser reactor when exiting at a temperature of at least 1000° F. This partial removal of hydrogen is desirable prior to oxygen regeneration of the catalyst because of the high heat released by combustion of hydrogen with oxygen. Thus by removing from 30 to 50% of the hydrogen with $CO_2$ in the stripper, heat management during oxygen regeneration may be more easily controlled.

As identified above, a reduced crude cracking operation differs in kind from a normal gas oil fluid cracking operation rather than just in degree because of the severity of the operation, the metal loading which must be tolerated by the cracking catalyst at desired catalyst activity as well as the high level of hydrocarbonaceous material (coke plus hydrogen) deposited on the catalyst during the cracking of high boiling carbo-metallic containing reduced crudes. In this severe catalyst deactivating operating environment, it is recognized that the deposited metals are associated with deposited hydrocarbonaceous material and applicants have observed that high temperature stripping in a turbulent atmosphere appears to contribute to some removal of deposited metals such as nickel since its level of accumulation does not continue to parallel that of vanadium.

It is contemplated effecting at least a partial removal of deposited carbonaceous material on the contaminated catalyst in a zone separate from the normal catalyst stripping zone accomplished with either $CO_2$ or steam. Thus the catalyzed reaction of $CO_2$ with carbon may be effected at temperatures in the range of 1300° to 1500° F. and hydrogen can be further removed with $CO_2$ as above discussed in substantial measure in a zone separate from the stripping zone or in an oxygen regeneration zone for the catalyst. Thus, it is contemplated effecting partial regeneration of the catalyst under endothermic regenerating conditions by reacting $CO_2$ with carbon and effecting further partial regeneration under exothermic conditions by burning a portion of the carbonaceous deposits with oxygen.

In the specific arrangement of FIG. 1, sequential regeneration of the catalysts may be accomplished with $CO_2$ in the stripper zone, and with oxygen containing gas in a sequence of regeneration zone or one of the regeneration zones such as the last zone may be employed for effecting a partial regeneration of residual carbon with $CO_2$ rich gas under endothermic regenerating conditions to remove the residual carbon thereby cooling the catalyst. On the other hand, initial removal of carbonaceous material may be accomplished with hot $CO_2$ rich gas and then with oxygen in a second stage. In any of these regeneration arrangements, the sequence of regeneration is selected and controlled to remove hydrocarbonaceous deposits within the management parameters discussed above and to provide a catalyst of low residual coke less than 0.1% by weight at a temperature below 1600° F. and preferably below 1500° F. More particularly, regeneration temperatures are maintained in the presence of steam below 1400° F. which will substantially limit or eliminate hydrothermal degradation of the catalyst and yet provide required endothermic temperature input to the reduced crude cracking operation in riser 4.

In a specific embodiment of the Figure, the stripped catalyst is passed in conduit 18 to a first stage of catalyst regeneration in catalyst bed 22 maintained in the upper portion of vessel 20. Regeneration gas is provided to the lower portion of bed 22 by conduit 24 to plenum chamber 26 and thence through distributor arm means 27. In addition, gaseous products of regeneration effected in a lower zone comprising bed 34, pass through passageways 29 in baffle 28. Since the regeneration flue gases of the regeneration operation herein contemplated are compatible with one another, the regeneration system of FIG. 1 is a most versatile system for accomplishing desired carbon removal to a desired low level and is implemented to some considerable extent when removing hydrogen with $CO_2$ in the stripping zone. When charging oxygen containing gas by conduit 24 to catalyst bed 22, it is desirable to accomplish a partial burning of the deposited carbonaceous material and hydrogen on the catalyst under restricted conditions of temperature and oxygen concentration providing a flue gas rich in CO. It is desirable to restrict the regeneration temperatures therein from exceeding about 1400° F., and preferably restricted not to exceed about 1350° F.

Flue gas products of combustion obtained in bed 22 which are CO rich pass through cyclone arrangements 30 in the absence of afterburning for removal of entrained fines before passage to a CO boiler not shown. On the other hand the CO rich flue gas may be passed to a separate combustion zone to burn combustible material such as CO and produce a high temperature $CO_2$ rich gas in the range of 1000° F. to about 1500° F. for use as herein provided.

The partially regenerated catalyst obtained as above provided is passed by one or both standpipes 36 and 40 to bed 34 in the lower portion of the regeneration vessel. A heat exchange means 38 is provided in conduit 36 should there be a need to heat or cool catalyst passed through conduit 36. In a regeneration operation involving two stages of oxygen combustion, heat exchanger 38 may be employed to effect some cooling of catalyst passed through standpipe 36 and before discharge in the lower catalyst bed. In catalyst bed 34, a burning of residual carbon and any hydrogen if present, depending on that accomplished in the stripper and in bed 22 is further accomplished by adding an oxygen containing gas such as air by conduit 42. On the other hand, some $CO_2$ may be added to reduce the concentration of oxygen in the gas employed in the second regeneration zone comprising bed 34. It is also contemplated completing regeneration by reacting $CO_2$ with the residual carbon in bed 34. Regeneration of the catalyst accomplished in bed 34 is a temperature restricted clean-up operation designed and operated to remove residual hydrogen if present and particularly to reduce residual carbon on the catalyst to a low value below about 0.5 wt% and preferably below 0.1 wt%. In this clean-up regeneration operation, it is desirable to restrict the regeneration temperature not to exceed about 1500° F. and preferably the regeneration temperature is restricted not to exceed about 1400° F. or 1450° F. This temperature restriction will remain the same whether oxygen or $CO_2$ regeneration of the catalyst is pursued in this cleanup operation.

The catalyst regenerated according to one of the sequences above provided is withdrawn by conduit 44 for passage at an elevated temperature in a lower portion of riser 4. It is contemplated stripping the regenerated catalyst in a stripping zone not shown within or external of bed 34 with $CO_2$ or other gas suitable for the purpose to remove combustion supporting gases from the withdrawn catalyst. It is desirable when the catalyst is regenerated with $CO_2$ or oxygen in bed 34 to strip the catalyst to remove any entrained (CO) carbon monoxide before charging the catalyst to the riser.

While this invention may be used with single stage regenerators or with multiple stage regenerators which have basically con-current instead of countercurrent flow between combustion gases and catalyst, it is especially useful in regenerators of the type shown in the Figure, which have countercurrent flow and are well-suited for producing combusiton product gases having a low ratio of $CO_2$ to CO, which helps lower regeneration temperatures in the presence of high carbon levels.

Having thus described this invention, the following Examples are offered to illustrate the invention in more detail.

EXAMPLE 1

A carbo-metallic feed at a temperature of about 350° F. is introduced into a homogenization vessel together with liquid water at a water-to-feed ratio by weight of 0.25. The pressure in the vessel is 135 pounds per square inch absolute. The homogenizer is a Kady Mill employing the mixing apparatus as described in the invention. The water contains 0.1 wt% of a petroleum sulfonate as an emulsifying agent.

The resulting homogeneous mixture is atomized into droplets having an average droplet size of about 100 microns and is introduced into a bottom portion of a riser reactor zone at a rate of about 2000 pounds per hour of feed where it is mixed with a zeolite-containing cracking catalyst at a temperature of about 1275° F. The ratio by weight of catalyst to oil is about 11:1.

The carbo-metallic feed has a heavy metal content of about 5 parts per million Nickel Equivalents, a Conradson carbon content of about 7 percent, and contains about 500 ppm nitrogen in the form of basic nitrogen compounds. Substantially all of the feed boils above 650° F. and about 20% of the feed does not boil below about 1025° F.

The catalyst is an alumino silicate zeolite dispersed in a silica alumina matrix, the zeolite being present in an amount of about 15% by weight. The matrix has substantial feeder pores with a diameter in excess of about 400 angstroms. The catalyst particles have an average diameter of about 80 microns, a bulk density of about 1.0, and a total pore volume of about 0.6 cc per gram.

Within the riser about 75 percent of the feed is converted to fractions boiling at a temperature less than 430° F. About 53 percent of the feed is converted to gasoline, and about 11 percent of the feed is converted to coke.

The catalyst containing about one percent by weight of coke is removed from the reactor and introduced into a stripper where it is contacted with stripping gas at a temperature of about 1000° F. to remove volatiles adsorbed onto the catalyst. The stripped catalyst is introduced into the upper zone of a two-zone regenerator as shown in FIG. 1 at a rate of 23,000 pounds per hour. Each zone contains about 4000 pounds of catalyst. Air at a temperature of about 100° F. and a flow rate of about 1200 pounds per hour is introduced into the upper zone. In one specific embodiment, air is introduced into the lower zone at a rate of about 1400 pounds per hour and at a temperature of about 100° F.

The regenerator flue gases are at a temperature of about 1400° F. and contain $CO_2$ and CO in a mole ratio of 3.6, $CO_2$ and CO being generated at a rate of 14 and 4 pound moles per hour respectively. The temperature in the upper zone and lower zones are maintained at about 1300° F. and 1340° F. respectively. The catalyst transferred from the upper zone to the lower zone contains about 0.25 percent coke by weight and the catalyst removed from the lower zone and recycled to the reactor riser contains about 0.03 percent coke by weight.

What is claimed is:

1. A Process for converting carbo-metallic oil feeds to lighter products comprising:

(a) providing a pre-heated carbo-metallic oil feed containing 650° F.+material, said 650° F.+material being characterized by a carbon residue on pyrolysis of at least 1 and containing at least about 4 ppm of Nickel Equivalents;

(b) introducing said feed into a homogenization zone together with liquid water at a weight ratio to feed of about 0.04 to about 0.25, and said zone being pressurized to a pressure in the range of about 100 to about 400 psig;

(c) forming in said zone a homogeneous mixture of said feed and said liquid water;

(d) atomizing said mixture into droplets having an average droplet size in the range of about 1,000 microns to about 100 microns, and introducing said droplets into the bottom of a progressive flow reaction zone for contact with crystalline zeolite cracking catalyst particles to form a suspension thereof at a cracking temperature above 900° F., passing the suspension through a progressive flow reaction zone for a vapor residence time in the range of about 0.5 to about 5 seconds and a pressure of about atmospheric up to about 100 lbs. per square inch gauge, said operating conditions causing oil feed conversion per pass in the range of about 50% to about 90% and depositing hydrocarbonaceous material on the catalyst equivalent to an amount of coke of 14% by weight based on fresh feed;

(e) separating said suspension into a catalyst phase and a vaporous product phase of said cracking at a temperature in the range of about 950° to about 1,200° F.;

(f) stripping vaporous hydrocarbon from said catalyst phase;

(g) regenerating said catalyst phase; and (h) recycling regenerated catalyst at an elevated temperature to the riser zone.

2. The process of claim 1 wherein a fluidizing gasiform diluent material is charged to the progressive flow reaction zone to aid atomization of the charged oil-water mixture.

3. The process of claim 2 wherein the diluent comprises a material selected from the group consisting of steam, naphtha, $CO_2$, $C_1$ to $C_5$ alcohols and combinations thereof.

4. The process of claim 2 wherein the diluent comprises fuel gases.

5. The process of claim 1 wherein a dispersant is employed with said water to form fine droplets of water in said oil feed.

6. The process of claim 5 wherein said dispersant is selected from the group consisting of $C_1$–$C_5$ alcohols.

7. The process of claim 6 wherein the dispersant is either methanol or isopropanol.

8. The process of claim 1 wherein a dispersant material is mixed with said water-oil feed mixture and contributes labile hydrogen upon contact with the zeolite cracking catalyst at cracking conditions in the riser.

9. The process of claim 1 wherein stripping of the separated catalyst phase is accomplished with either steam or $CO_2$.

10. The process of claim 1 wherein regeneration of the catalyst is accomplished with one or both of oxygen and $CO_2$ in separate stages of catalyst regeneration.

11. The process of claim 10 wherein regeneration of the catalyst with oxygen containing gas is accomplished under temperature conditions restricted not to exceed about 1400° F. and provide a regenerated catalyst of residual carbon less than 0.1 wt%.

12. The process of claim 10 wherein a substantial portion of hydrogen deposited in hydrocarbonaceous material is removed therein with $CO_2$ in the range of 900° to 1400° F. and before contact with an oxygen containing regeneration gas.

13. The process of claim 1 wherein said water and said carbon-metallic oil feed is homogenized in the presence of a dispersant material and said homogenized mixture is charged with a fluidizing gasiform medium under conditions to effect atomization and vaporization of the homogenized mixture in contact with charged catalyst to form a dilute suspension for flow through the reaction zone restricted to a residence time in the range of 0.5 to 3 seconds under cracking temperature conditions.

14. The process of claim 1 wherein the carbo-metallic oil is selected from the group consisting of vacuum gas oil, reduced crude, vacuum gas oil containing 0 to 25 wt% of a reduced crude, topped crude, whole crude oil, a residual oil and liquid fractions from coil liquefaction, oil shale retorting and tar sands beneficiation.

15. The process of claim 1 wherein the carbo-metallic oil contains 100 ppm or less of metals consisting of Ni, V, Fe and Cu and has a Conradson carbon value of 2–12 wt%.

16. A process of claim 1 wherein the carbo-metallic oil feed contains 200 ppm or less of metals consisting of Ni, V, Fe and Cu and has a Conradson carbon value of 2–12 wt%.

17. A process according to claim 1 wherein the feed contains vanadium and nickel in a vanadium to nickel ratio in the range of from about 1:3 to about 5:1.

18. A process according to claim 1 wherein from about 20 percent to about 80 percent of the total metal content of the feed consists of vanadium and nickel in a vanadium to nickel ratio in the range from about 1:3 to about 5:1.

19. A process according to claim 1 wherein the feed as a whole contains from about 10 to about 1000 ppm of nitrogen in the form of basic nitrogen compounds.

20. A process according to claim 1 wherein the feed as a whole contains at least about 10% of material which will not boil below about 1025° F.

21. The process according to claim 1 wherein the catalyst comprises a crystalline zeolite with a matrix material and said matrix material contains pore size openings in the range of about 500 to about 6,000 angstroms.

22. The process of claim 1 wherein the catalyst comprises one or more crystalline zeolites within a matrix, said zeolites comprised of one or more of types X, Y, mordenite, A, in admixture with a matrix comprising one of pillared interlayered clays, kaolin and activated clays.

23. A process according to claim 1 wherein the equilibrium catalyst recycled in said process comprises an accumulation of heavy metals on said catalyst derived from prior contact under conversion conditions with carbo-metallic oil, said accumulation including from about 1,000 ppm to about 20,000 ppm of Nickel Equivalents of heavy metal(s) by weight.

24. The process according to claim 1 wherein the carbo-metallic oil and water is mixed in a homogenization section prior to contact with hot regenerated catalyst.

25. The process of claim 1 wherein the carbo-metallic oil feed is brought together with liquid water in a weight ratio relative to feed in the range of about 0.04 to about 0.25.

26. The process of claim 1 wherein the homogenized mixture of water and carbo-metallic oil feed is dispersed with a diluent material to give oil droplets having an average diameter less than about 350 microns.

27. A process for converting carbo-metallic oils to lighter products which comprises;

providing a carbo-metallic oil feed containing 650° F.+material, said 650° F.+material being characterized by a carbon residue on pyrolysis of at least about one and by containing at least about 4 ppm of Nickel Equivalents of heavy metals; homogenizing a mixture of said feed, water and an emulsifying agent;

passing the resulting homogenized mixture of feed, water and emulsifying agent into atomized contact with a fluid cracking catalyst to form a suspension with said catalyst, passing the suspension through an elongated reaction zone for a vapor residence time in the range of about 0.5 to about 10 seconds, at a temperature in the range of about 900° F. to about 1200° F. and a pressure up to about 50 pounds per square inch gauge obtaining a conversion per pass of said oil feed in the range of about 50% to about 90% while producing coke in amounts in the range of about 6 to about 14% by weight based on fresh feed, and laying down coke in the form of hydrocarbonaceous material on the catalyst in amounts in the range of about 0.3 to about 3% by weight; separating catalyst from the resultant products of oil feed emission; stripping vaporous hydrocarbons from said separated catalyst;

regenerating said catalyst; and recycling the regenerated catalyst to the reactor for contact with additional homogenized oil feed mixture.

28. A method for catalytically converting vacuum gas oils comprising carbo-metallic oil impurities of asphaltenes, naphthenes and prophyrins to form gasoline, lower and higher boiling fuels which comprises, dispersing water in said vacuum gas oil in the presence of a lower alcohol dispersant whereby fine water droplets are homogenously in admixture with said oil feed atomizing the oil feed dispersed with fine droplets of water with a fluidizing and atomizing gasiform diluent material upon charging contact with hot catalyst of regeneration at a temperature below 1500° F. to form an intimate suspension therewith for flow through a riser contact zone for a cracking contact time less than about 3 seconds to achieve at least 60% conversion of the oil feed on a once through basis, separating the suspension into a hydrocarbon phase comprising gasiform diluent material separate from a catalyst phase comprising hydrocarbonaceous deposits recovering gasoline, lower and higher boiling fuels from said hydrocarbon phase, stripping said catalyst phase comprising hydrocarbonaceous deposits at a temperature of at least 1000° F., regenerating the stripped catalyst to remove carbonaceous deposits comprising hydrogen with regeneration gases at a temperature restricted to produce recoverable CO rich flue gases and provide a regenerated catalyst comprising less than 0.1 wt% carbon thereon, and recycling regenerated catalyst thus obtained to said gas oil cracking step.

* * * * *